2/11/86 OR 4,569,805

United States Patent [19]

Hume et al.

[11] Patent Number: 4,569,805

[45] Date of Patent: Feb. 11, 1986

[54] APPARATUS FOR THE SUBMERGED INTRODUCTION OF A FLUID INTO A BODY OF LIQUID

[75] Inventors: Ross G. Hume, Whitby; James K. Leitch, Toronto, both of Canada

[73] Assignee: The Gray Engineering Group Inc., Markham, Canada

[21] Appl. No.: 656,079

[22] Filed: Sep. 28, 1984

[51] Int. Cl.[4] ..... B01F 3/04

[52] U.S. Cl. ..... 261/122

[58] Field of Search ..... 261/122

[56] References Cited

U.S. PATENT DOCUMENTS

| | | | |
|---|---|---|---|
| 3,768,788 | 10/1973 | Candel | 261/122 |
| 4,007,240 | 2/1977 | Gosden | 261/122 |
| 4,288,394 | 9/1981 | Ewing et al. | 261/122 |

FOREIGN PATENT DOCUMENTS

| | | | |
|---|---|---|---|
| 72340 | 3/1951 | Denmark | 261/122 |
| 1086447 | 4/1954 | France | 261/122 |
| 1511656 | 5/1978 | United Kingdom | 261/122 |

*Primary Examiner*—Tim Miles

*Attorney, Agent, or Firm*—Sommer & Sommer

[57] ABSTRACT

A fluid supply pipe has uniformly spaced diffuser location holes arranged in a line along its length at each of which a saddle is secured to the pipe which includes changeable means for controlling the desired flowrate of fluid from the pipe to a diffuser. The saddle has a threaded connection with the diffuser so that the diffuser can be readily screwed onto or unscrewed from the saddle by hand. The plenum below the diffuser element has a self-draining feature.

13 Claims, 15 Drawing Figures

Fig. 7.
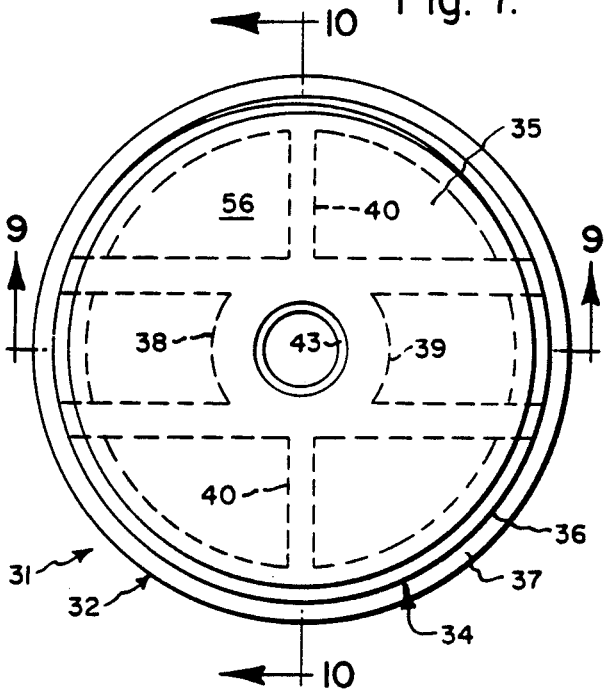
Fig. 8.
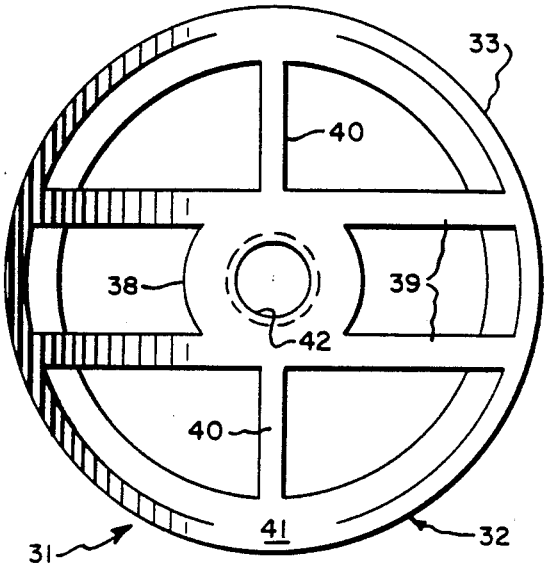
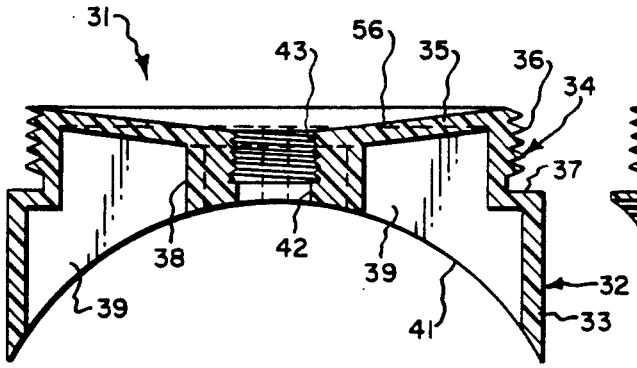
Fig. 9.
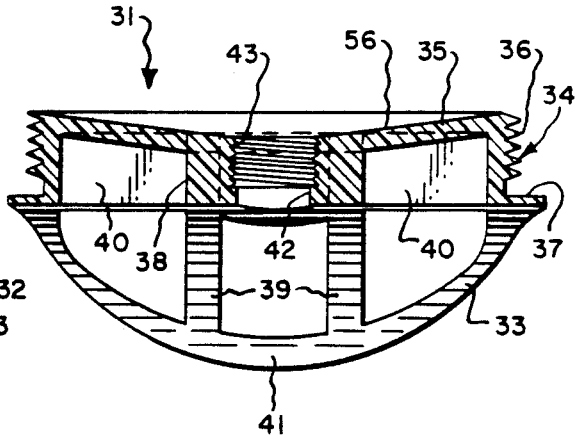
Fig. 10.

Fig. 11
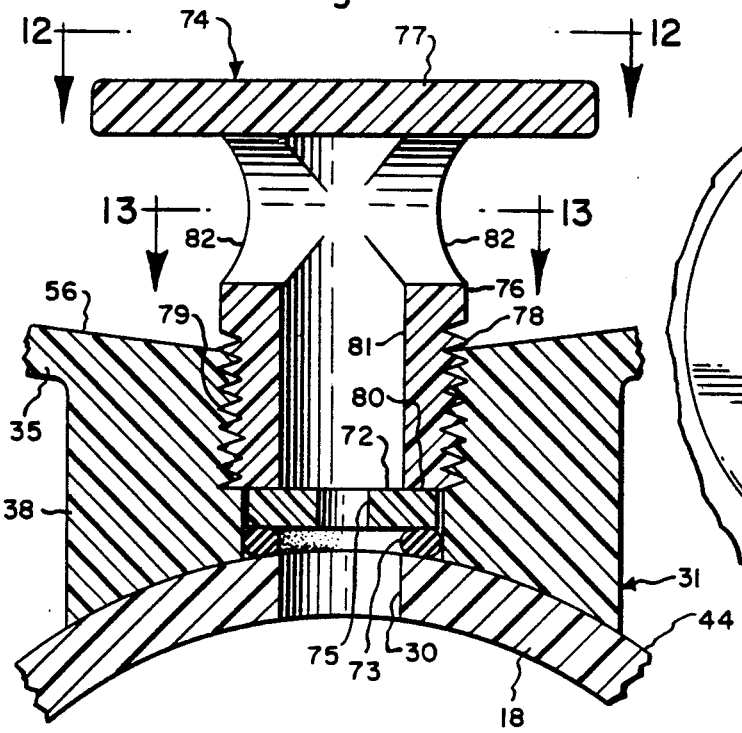
Fig. 12.
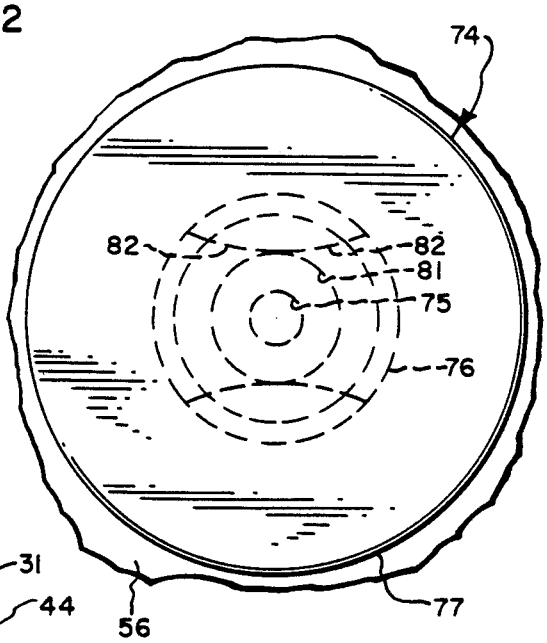
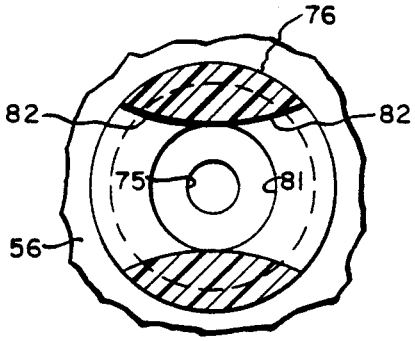
Fig. 13.
Fig. 14.
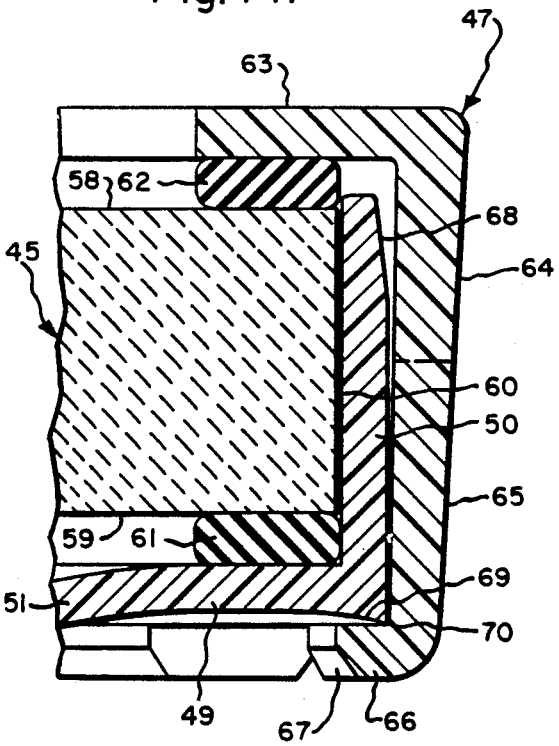
Fig. 15.
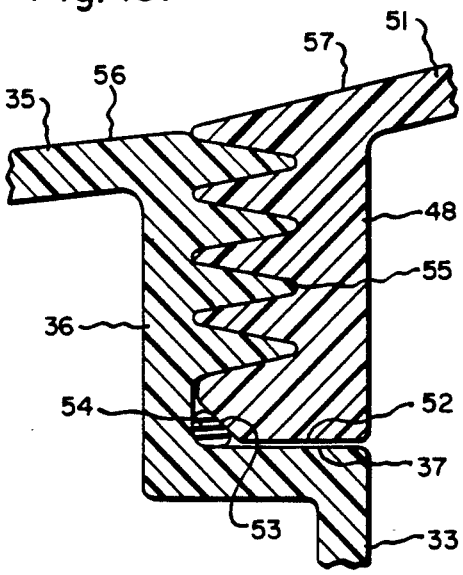

APPARATUS FOR THE SUBMERGED INTRODUCTION OF A FLUID INTO A BODY OF LIQUID

FIELD OF THE INVENTION

This invention relates to the field of apparatus for the submerged introduction of a fluid into a body of liquid, such as apparatus for aerating sewage, and more particularly with respect to improvements in such apparatus.

BACKGROUND OF THE INVENTION

In apparatus for aerating sewage, for example, it is common to provide a submerged grid of air supply pipes supporting a plurality of porous ceramic diffusers which discharge the air in the form of fine bubbles to rise through the liquid sewage body for aerating the same. The pipes and diffuser supported thereon are preferably arranged so that the degree of aeration is greater near the sewage inlet and decreases toward the outlet where less aeration is required. It is essential that the effluent surfaces of the various diffusers be arranged at the same level, within a close tolerance, so that the head of liquid thereon is substantially uniform.

Heretofore, the diffuser surface density per unit of tank area was planned in advance of installation of the equipment by spacing diffusers at different intervals along the air supply pipe. After installation in some instances it was found from actual operating experience that the diffuser surface density was not proper. Usually too much aeration was found to have been supplied, resulting in excessive power cost. In order to reduce the power cost, curtailing the aeration by throttling the air supply had practical limitations. The situation was typically corrected by draining the tank and either replacing the pipe with diffusers at a different spacing, or modifying the pipe by plugging some diffuser service holes and providing new holes, with attendant diffuser mounting difficulties. Sometimes the diffusers were replaced with ones of different size but the construction of diffuser units and its mounting mode was such that special cleaning and special tools were required.

From time to time in the operation of a diffused aeration system for wastwater using ceramic fine bubble equipment, a power failure occurs and the supply of gas such as air is cut off. Back pressure in the system drains liquid and suspended solids, such as activated sludge, through the diffuser and into the air pipework and in the air plenum beneath the diffuser. On restoration of air supply, this regressed liquid and susended solids mixture is blown back through the pipework. However, because prior art diffusers were so designed, either when mounted on the crown of a pipe or with a center bolt hold-down construction, recessed or dead pocket cavities existed within the air plenum where residual liquids or solids accumulated. The residual liquid evaporated leaving the suspended and dissolved solids in those cavities. On restoration of the air supply, these accumulated solids could be blown against the underside or influent side of the diffuser elements causing air-side fouling of the diffusers with an attendant loss in efficiency.

SUMMARY OF THE INVENTION

The primary objective of the present invention is to reduce the power required, and hence its cost, in providing pressurized fluid for producing the optimum aeration level in various places throughout the tank in which the liquid body being treated is confined.

The present invention avoids the disadvantages, deficiencies and limitations of the aforementioned prior art practices in seeking to achieve the above-stated objective, by providing fluid supply pipe in lengths having uniformly spaced diffuser location holes arranged in a line along its length, a saddle on which a diffuser assembly can be easily mounted that can be easily secured to the pipe at each hole and which includes readily varied means for controlling the flow of fluid through the hole, including complete shut-off.

Utilizing fluid supply pipe having uniformly spaced holes along its length has the advantage of avoiding the complication and attendant high cost of providing pipe with a predetermined but variable hole spacing.

Another advantage of the present invention is the provision of a saddle of novel structure which can be easily secured on the length of fluid supply pipe at each hole location, and on which saddle a diffuser assembly having a predetermined diffuser surface area can be readily mounted.

Another advantage is that lengths of pipe can be provided with the saddles factory installed, with the fluid flow control means included, which can be compactly crated due to low profile, shipped to the work site, installed in the treatment tank and thereafter have removably mounted thereon without the use of tools diffuser assemblies selected from a group of several different sizes having different effective effluent surface areas but otherwise of similar construction.

Another advantage is that the diffuser assemblies are interchangeable in the field in order to provide the desired effluent diffusion surface density per unit of tank area, and thereby permit process flexibility and efficiency.

Another advantage is to provide the aforementioned interchangeability of diffuser assemblies which will maintain the same elevation of effluent surface of the diffuser elements in relation to the fluid supply pipe.

Another advantage is that the flow control means mounted on the saddle can be produced with a high degree of repeatable accuracy.

Another advantage is that the orifice size of the fluid flow control means can be changed with ease.

Another advantage is that the saddle has a configuration which permits of being wiped off after the tank is drained and the saddle hosed off, rather than requiring being wiped out as obtains with some prior art diffuser configurations.

Still another advantage is that the saddle and the diffuser element holder mounted thereon provide a drainable basin configuration which eliminates dead-pocket cavities into which bodies of back-flow liquid may be trapped, and thereby provide a totally self-draining feature of the plenum beneath the diffuser element.

Other objects and advantages of the present invention will be apparent from the following detailed description of a preferred embodiment shown in the accompanying drawings.

BRIEF DESCRIPTION OF THE DRAWINGS

FIG. 7 is a top plan view of the saddle by itself, shown in FIGS. 5 and 6, on which the diffuser is supported.

FIG. 8 is an elevational view of the bottom of the saddle shown in FIG. 7.

FIG. 9 is a vertical central transverse sectional view of the saddle, taken on line 9—9 of FIG. 7.

FIG. 10 is a vertical central longitudinal sectional view of the saddle, taken on line 10—10 of FIG. 7.

FIG. 11 is an enlarged sectional view of the central portion of the mounted saddle, the view being an enlargement of the box area designated FIG. 11 in FIG. 6, and illustrating on a larger scale the flow control means and air deflector.

FIG. 12 is a top plan view of the air deflector shown in FIG. 11, taken on line 12—12 thereof.

FIG. 13 is a horizontal sectional view of the air deflector, taken on line 13—13 of FIG. 11.

FIG. 14 is an enlarged fragmentary sectional view of a marginal portion of the diffuser, the view being taken of the box area designated FIG. 14 in FIG. 6.

FIG. 15 is an enlarged fragmentary sectional view of the threaded connection portion of diffuser mounting, the view being taken of the box area designated FIG. 15 in FIG. 6.

DETAILED DESCRIPTION OF THE PREFERRED EMBODIMENT

Figure 1:
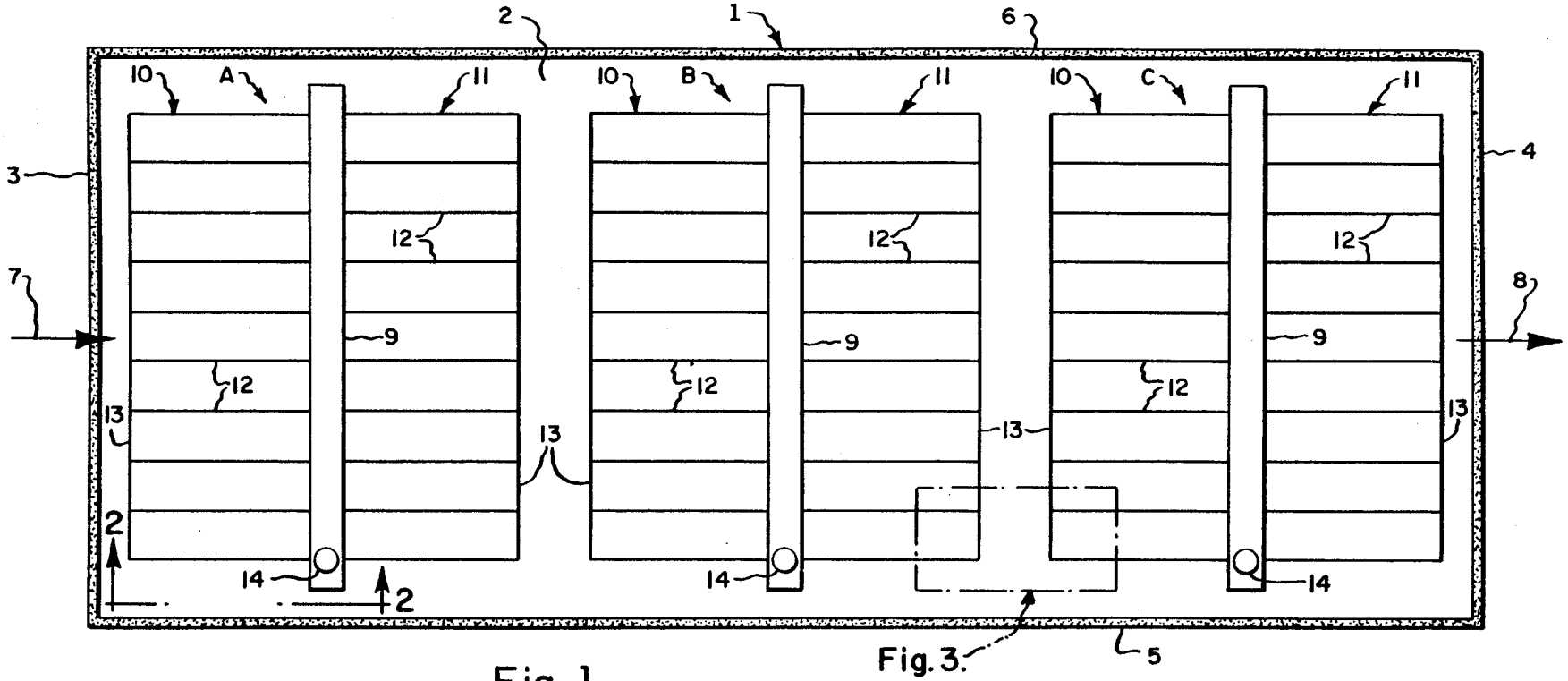
FIG. 1 is a top plan schematic view of a sewage aeration tank showing representative grids of header pipes and diffusers.

Referring to FIG. 1, there is shown, somewhat schematically, as illustrative of the application of the present invention, an elongated rectangular tank 1, including a bottom 2, end walls 3 and 4, side walls 5 and 6, a liquid inlet 7 through end wall 3, and a liquid outlet 8 through end wall 4.

As is well known to those skilled in the art, the liquid to be treated such as sewage, is aerated by submerged pipework on which diffusers are mounted to produce fine bubbles which rise through the liquid and aerate the same. This pipework is shown in FIG. 1 as arranged in three grids, designated A, B, and C, respectively.

Each such grid is shown in FIG. 1 as including a central horizontal manifold 9 extending transversely of tank 1 for supplying fluid such as air at the appropriate pressure to a left series 10 and a right series 11 of horizontal lateral distribution headers 12 extending laterally from opposite sides of manifold 9, suitably communicatively connected thereto at their proximate ends, and at their distal ends suitably communicatively connected together by grid end connectors 13. Each manifold 9 is a pipe suitably closed at opposite ends, and near one end is suitably communicatively connected to a riser 14 which supplies gas from a source such as an overhead main (not shown) leading to blowers (not shown).

Figure 2:
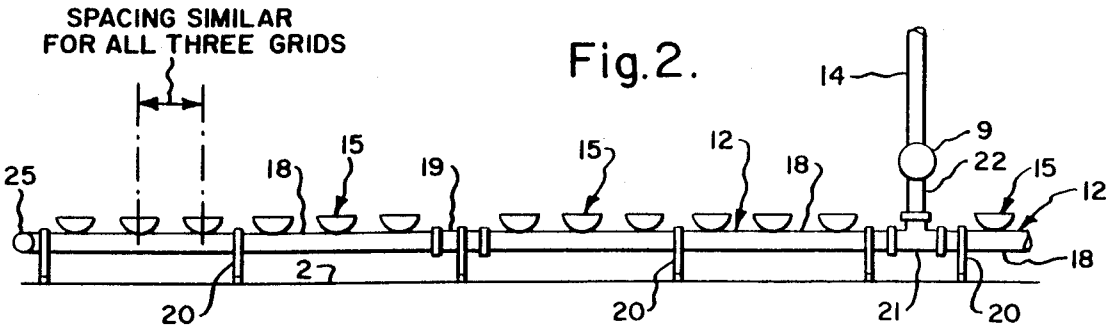
FIG. 2 is a side elevational view of a portion of one of the grids shown in FIG. 1, taken on line 2—2 thereof, and showing a distribution header on which are mounted a number of diffusers of the largest of a group of three different sizes having different effective effluent surface areas but otherwise of similar construction.

Referring to FIG. 2, a portion of grid A is shown in greater detail and is representative of the construction of the other grids B and C, except for the size of diffuser. Typically, the diffusers are provided in three different sizes. As shown in FIG. 2, grid A includes diffusers 15 all of a large size. Grid B includes diffusers 16 all of an intermediate size, and grid C includes 17 all of a small size, as shown in FIG. 3.

As known by persons skilled in the art, it is desirable to provide diffusers in the grids A, B and C which will produce diffuser effluent surface area densities in different parts of tank 1 so as to aerate efficiently the liquid therein, such as sewage. Providing an excess of sewage aeration is ineffectual, wastful, and costly principally in the increased energy cost to drive the blowers. The diffuser effluent area density needs to be greatest in the end portion of tank 1 adjacent inlet 7, lowest in the end portion of the tank adjacent outlet 8, and intermediate in the central portion of the tank.

Figure 3:
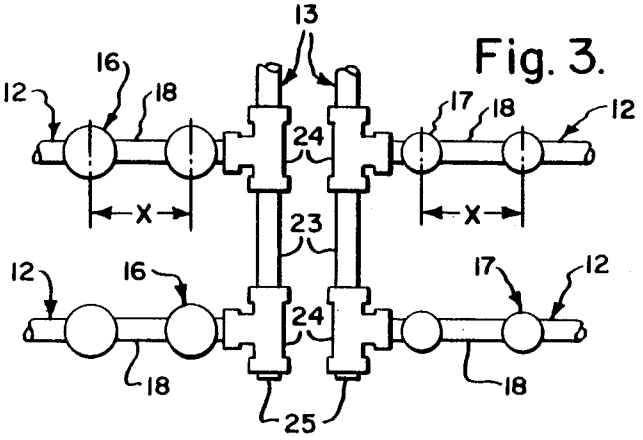
FIG. 3 is a fragmentary top plan view of portions of adjacent grids shown in FIG. 1, the view being an enlargement of the box area designated FIG. 3 in FIG. 1.

In accordance with the present invention, this is achieved by providing lateral headers 12 severally including lengths of pipe 18 having a standardized location of diffusion points, the spacing between which is represented by the distance X, as shown in FIG. 3. This spacing is similar for all three grids A, B and C. The diffusers 15-17, arranged at the multiplicity of diffuser locations in these grids, have different effective effluent areas all at the same elevation in the tank so that the liquid head is constant on each diffuser.

Referring again to FIG. 2, each header 12 is shown as comprising two aligned lengths of cylindrical pipe 18,18 connected at their opposing ends by a suitable expansion coupling 19 of known construction to those skilled in the art, and supported at suitable intervals along their collective length by suitable supports 20 of known construction anchored to the tank bottom or floor 2. Five such supports 20 are shown in FIG. 2 for the header 12 there illustrated in full length. The corresponding ends of headers 12 in each series 10 and 11 are connected to the opposite lateral outlets of suitable transition tees 21 of known construction. The upper outlet of each tee 21 is suitably connected to the corresponding manifold 9, as by a stub or nipple 22.

Referring to FIG. 3, the grid end connectors 13 comprise short lengths of pipe 23 suitably connected to the two aligned outlets of a suitable expansion tee 24, the third outlet of which is suitably connected to the adjacent distal end of the corresponding header 12. The free outlets of the end tees 24 are suitably closed as indicated at 25 in FIG. 3.

It will thus be seen that each grid includes a plurality of communicating pipes on the tops of some of which, namely, the lateral headers 12, are mounted one size of diffuser selected from the group 15-17. At this juncture, it is pointed out that while the diffusers in a given one of the grids A, B, and C are described as being all of the same size, it is to be understood that the different sizes of diffusers 15, 16 and 17 are so similarly constructed, as will be explained later herein, such that diffusers of different sizes are interchangeable one with another whereby each grid may contain a mixture of two or more differently sized diffusers to provide the aeration density desired in a given area of the tank. The arrangement illustrated in FIG. 1 is merely an example of one possible arrangement of different size diffusers.

The construction of a representative size of diffuser and its mode of mounting at one diffuser location on a lateral header will now be described. One of the intermediate size diffusers 16 shown in FIG. 3 has been selected for this purpose.

Figure 4:
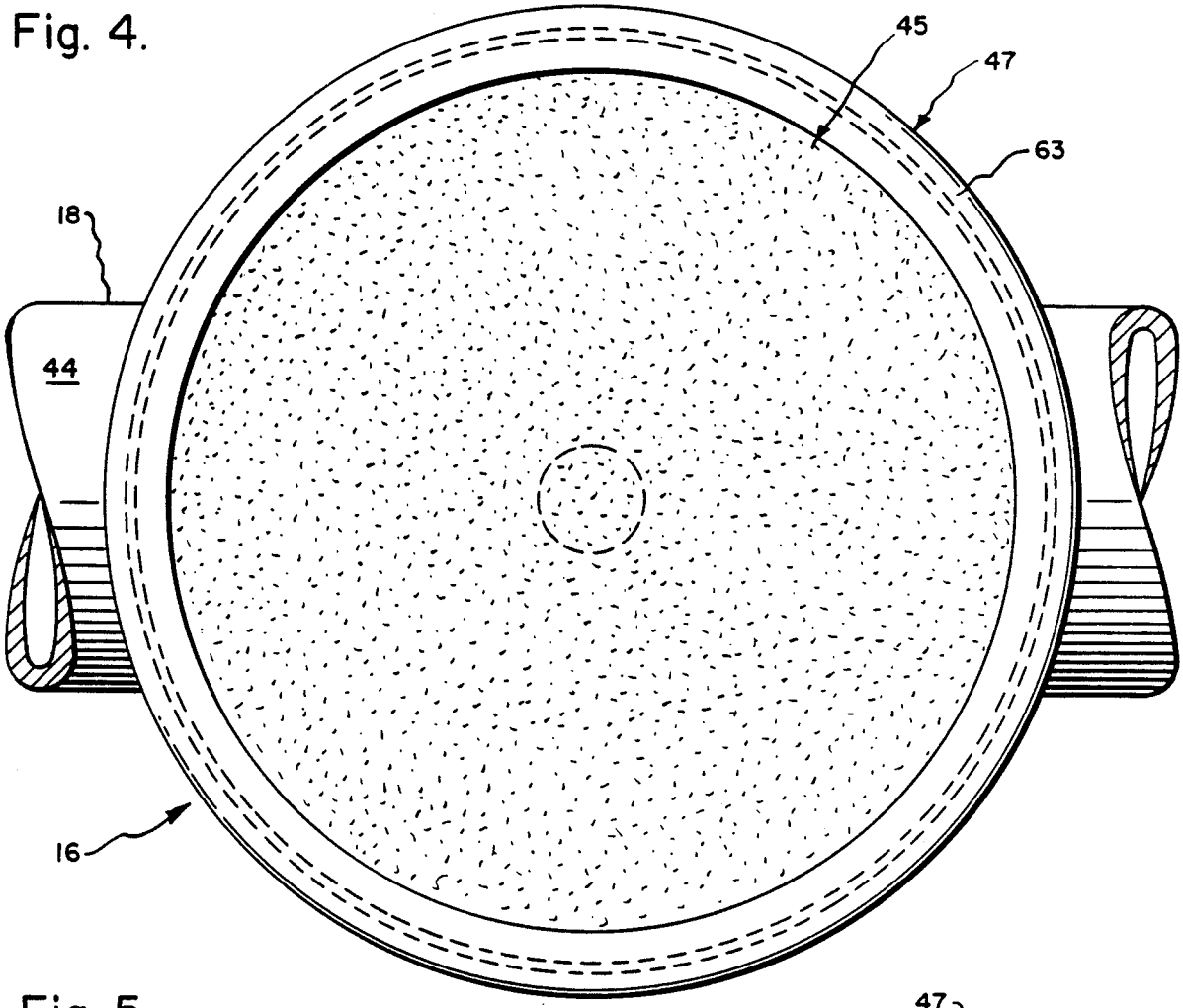
FIG. 4 is an enlarged top plan view of one of the intermediate sized diffusers and a portion of associated pipe shown in FIG. 3.
Figure 5:
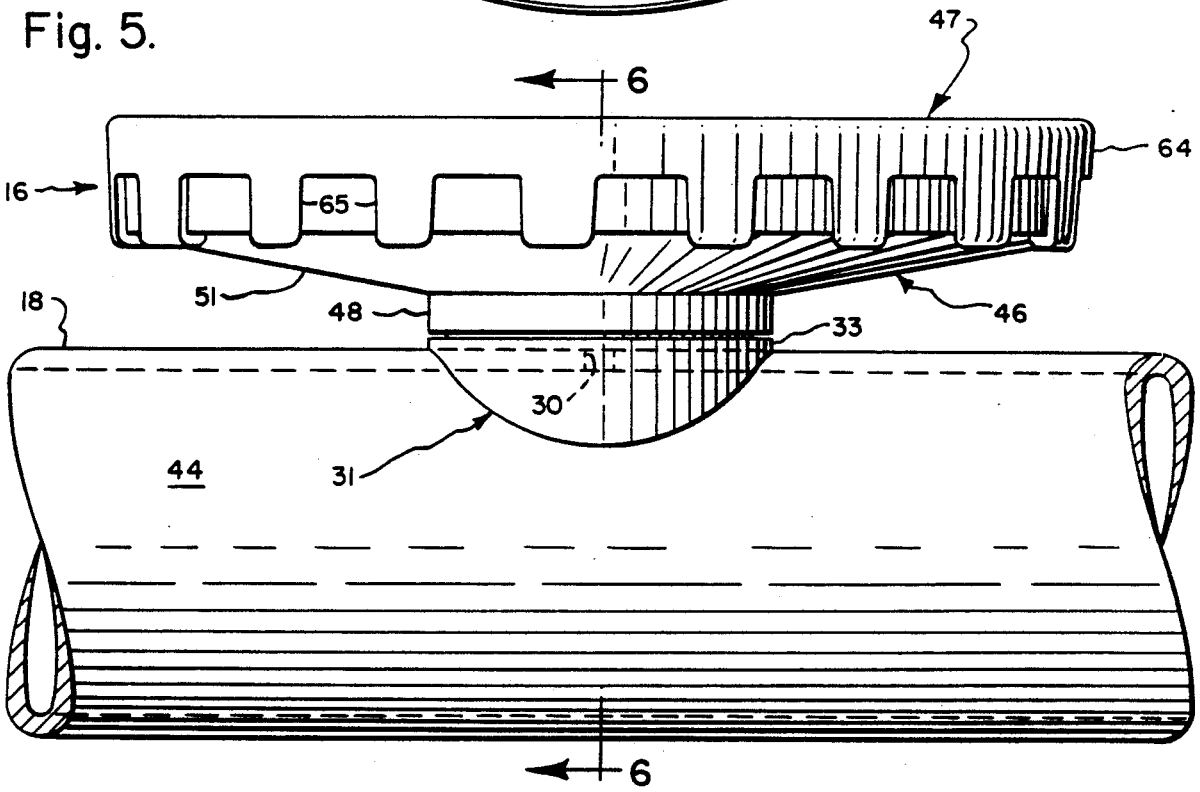
FIG. 5 is a side elevational view of the diffuser and pipe shown in FIG. 4.
Figure 6:
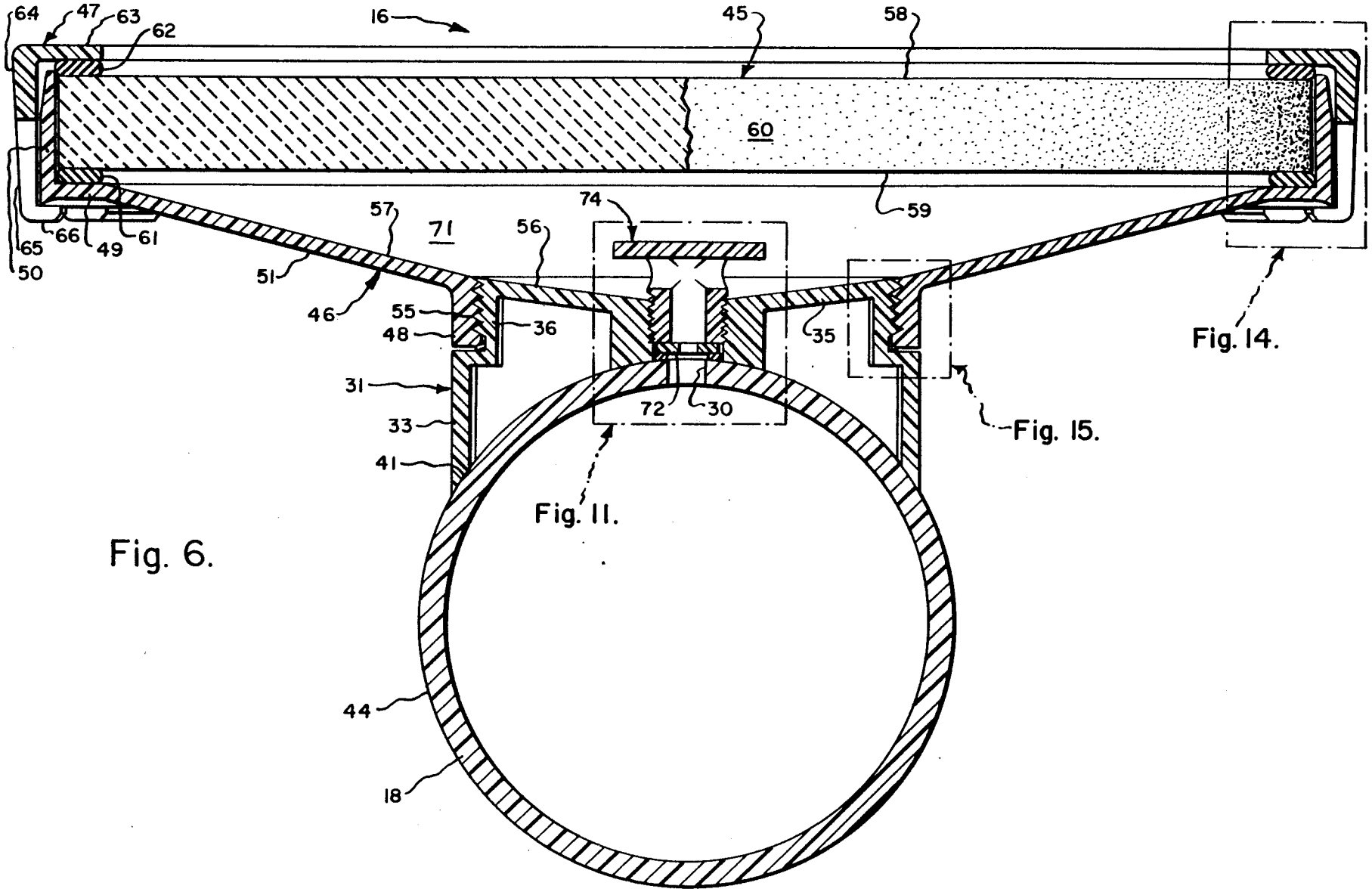
FIG. 6 is a still further enlarged vertical central sectional view of the diffuser and pipe shown in FIG. 5, taken on line 6—6 thereof.

Referring to FIGS. 4–6, one of the header pipes 18 is shown as having a radial through hole 30 in its top. Covering this hole is a saddle 31 on which diffuser 16 is mounted.

Referring to FIGS. 7–10, saddle 31 is illustrated by itself. As there shown saddle 31 is a stepped one-piece structure of cylindrical outline as viewed from above, including a lower mounting portion 32 having an outer cylindrical wall 33, and an upstanding boss portion 34 having a top wall 35 and an externally threaded side wall 36 depending from the the rim thereof. An upwardly facing annular horizontal shoulder 37 is provided by the step between outer walls 33 and 36. Saddle 31 also includes a central cylindrical body portion 38 depending from top wall 35 and is connected by a pair of parallel spaced transverse webs 39,39 intersecting tangentially the periphery of central body portion 38 on opposite sides thereof and extending outwardly to join with outer walls 33 and 36. Saddle 31 also includes a pair of aligned radial webs 40,40 extending outwardly from opposite sides of central body portion 38 and joined to outer boss side wall 36.

As best shown in FIGS. 6 and 9, the bottom surfaces of lower wall 33, central body portion 38 and webs 39 and 40, are formed to provide a collective bottom surface 41 for the saddle 31, having a cylindrical profile when viewed axially of cylindrical pipe 18 and having substantially the same radius as for the exterior surface thereof, whereby the opposing surfaces of saddle and pipe are complementary and the saddle may be closely supported on this pipe when placed thereon with their opposing surfaces concentric. Saddle 31 is provided with a central hole 42 extending vertically through body portion 38, between top surface 35 and bottom surface 41. The upper portion of hole 42 is provided with internal screw threads 43 for a purpose described later herein.

When the saddle 31 is placed on pipe 18 the holes 30 and 42 in these members are in registry and preferably coaxially aligned.

While saddle 31 and pipe 18 may be secured together in any suitable manner, if both are made of a material such as polyvinylchloride (PVC), as is preferred, they may be solvent-welded together at the interface between saddle bottom surface 41 and the pipe exterior surface 44.

Diffuser 16 comprises a diffuser elment 45, a holder 46 therefor, and a snap-on collar 47 for sealingly securing the element to the holder. This holder 46 is shown as a one-piece member having a lower mounting part in the form of an internally threaded collar 48, an upper annular horizontal shelf part 49, an upstanding annular flange 50 rising from the outer rim of this shelf part, and an upwardly and outwardly extending intermediate part 51 connecting the upper end of collar 48 and the inner rim of shelf part 49.

The internal threads of collar 48 are adapted to have a threaded engagement with the external threads on saddle boss 34, so that the lower end face 52 of this collar can engage abuttingly saddle shoulder 37, as best shown in FIG. 15. Preferably the inner rim of collar 48 at its end face 52 is beveled, as indicated at 53, so as to engage an annular seal 54, such as an O-ring of suitable material, on shoulder 37 and thereby provide a sealed threaded connection 55.

The upper surface 56 of boss end wall 35 is concave or dished, preferably frusto-conical. The flaring intermediate holder part 51 has an upper surface 57, also preferably frusto-conical, which is substantially coterminous with surface 56 at the upper end of the threaded connection 55.

Diffuser element 45 is shown as a circular plate or disc having flat upper and lower surfaces 58 and 59, respectively, and a cylindrical periphery 60. This diffuser element is composed of crystalline fused alumina (aluminum oxide) with a suitable ceramic bonding material, and is commercially available in the geometry and porosity desired. An annular gasket 61 of suitable sealing material is interposed and compressed between lower diffuser element surface 59 and holder shelf part 49. A similar gasket 62 is shown sealingly engaging the upper surface 58 of the diffuser element.

Upper gasket 62 is engaged by the overlying inturned annular horizontal flange 63 of snap-on collar 47. This collar is a one-piece structure which also includes a side wall 64 depending as a skirt from the outer rim of flange 63 and closely surrounding the upper part of holder upstanding flange 50. Depending from the lower end of this side wall 64 is a series of circumferentially spaced bendable hooks 65, each having an inturned lug 66 at its lower free end. The inner lower corner of each lug is beveled, as indicated at 67, so as to engage an upwardly and inwardly inclined annular beveled surface 68 on the upper outer side of flange 50 when the snap-on collar 47 is pressed down over diffuser element 45 supported on holder 46, and thus facilitate application of the collar. The hooks flex outwardly to permit of this camming action, but swing inwardly when the lugs are free.

As best shown in FIG. 14, the lower surface of shelf part 49 at its outer border where it meets the outer peripheral face of flange 50 is downturned at a slight angle to horizontal, as indicated at 69, so as to provide an annular corner having a sharp edge 70 of less than a 90° extent or included angle between the meeting surfaces which form it when viewed in cross section. This sharp edge 70 digs into the bight of the inwardly biased hook 65 to provide a tight and secure mounting of the collar 47 which maintains gaskets 61 and 62 in a compressed sealing condition.

The upper coterminous surfaces 56 and 57 of the boss and holder, jointly with the lower surface 59 of the diffuser element, provide a plenum 71 having a dished floor or basin which slopes downwardly to central hole 42 in the saddle 31.

Means are arranged on this saddle for controlling the flow of fluid such as air from the interior of pipe 18 through hole 30 therein to plenum 71. Such means are shown as comprising a disk 72 arranged in saddle hole 42 and seated on an annular seal such as an O-ring 73 surrounding pipe hole 30. This O-ring has an inside diameter larger than that of hole 30, and is pressed against the exterior 44 of pipe 18 by a follower 74 having a threaded connection with threads 43 provided in the upper portion of this saddle hole.

It will be seen that if disk 72 is imperforate, and follower 74 is snugly screwed down against it, pipe hole 30 can be sealingly closed. However, when a positive flow of fluid from pipe 18 into plenum 71 is desired, disk 72 is provided with a central vertical through hole or orifice 75 of the desired size, as best shown in FIG. 11. There, follower 74 is shown as an air deflector having a tee-shaped profile provided by a cylindrical tubular body 76 and an overhanging cap 77. Body 76 has external threads 78 engaging internal saddle threads 43 to provide a threaded connection indicated at 79, a lower end face 80 engaging orificed disk 72, a central vertical passage 81 opening at its lower end to end face 80 and at its upper end communicating with laterally extending branch passages 82,82 which led to the exterior of body 76 on diametrically opposite sides thereof, immediately below cap 77.

Pressurized fluid such as air leaving pipe 18 through hole 30, flows through seal ring 73, through orifice 75, through central passage 81, and thence laterally through branch passages 82 into plenum 71. The hooded or capped lateral passages 82 operate to deflect incoming air laterally so as to distribute the air substantially uniformly across the underside of influent surface 59 of diffuser element 45. The air flows upwardly through the interconnected tiny passages in the porous diffuser element to form fine air bubbles on the upper side or effluent surface 58 of this element, which break away to form a column of discrete bubbles rising through the overhead liquid and aerate the same. Considerably less air escapes to the atmosphere if the bubbles are fine rather than coarse, and this reduces the power cost of aeration.

Preferably, the various components including saddle 31, holder 46, snap-on collar 47, disk 72, air deflector 74, pipe 18, expansion couplings 19, transition tees 22, expansion tees 24, connector pipes 23, manifold 9, nipples 22, and riser pipe 14, are made of polyvinylchloride (PVC).

The various seal members such as O-rings 54 and 73 and gaskets 61 and 62, and those seal members included in the expansion joints, may be made of a suitable sealing material such as polyisoprene, ethylene, propylene or neoprene.

Diffusers 15 and 17 differ from the representative diffuser 16 described in detail, only in the respects that their diffuser elements have a different diameter and the angularity of the sloping intermediate holder part 51 is changed to accommodate a diffuser element having a different diameter while still presenting its upper effluent surface when clamped on its holder at the same vertical spacing in relation to the lower end face 52 of holder collar 48, as well as the snap-on collar 47 being different in diameter to correspond to the diameter of the differently sized diffuser element.

Let it be assumed, for example, that for the large size diffuser 15 its exposed or effective effluent area has a diameter of about 12 inches, that for the intermediate size diffuser 16 is about 9.8 inches, and that for the small diffuser 17 is about 7 inches. This range of sizes is not critical and may be otherwise as desired. In order to have the spacing or normal distance between effluent upper diffuser 58 and holder collar lower end face 52 substantially the same in all sizes of diffusers, the angularity of sloped holder part 51 will be less for the large diffuser 15 and more for the small diffuser 17 than that for the intermediate size diffuser 16 illustrated.

It will be seen from an examination of FIGS. 5 and 6 that if diffuser element 45, holder 46 and snap-on collar 47 were provided as a subassembly, in any size of diffuser, 15–17, the same could be screwed onto the saddle 31 by hand until collar end face 52 abuts shoulder 37 and the effluent surface of any diffuser would be assured of being substantially at the same elevation.

It is preferred to provide lengths of pipe 18 having a row of holes 30 of uniform spacing, with each hole covered by a saddle 31 installed at the factory. These pipes with installed saddles have a low profile, enabling them to be compactly crated for shipment, with more to the crate than other pipe units heretofore used having alternating offset dome mountings, for example.

Moreover, by having a saddle construction adapted to receive different sizes of diffusers, the diffusers can be readily mounted in the field at the job site in any mixture and array desired, by merely screwing them down onto the externally threaded saddle bosses until bottomed on the saddle shoulders. By the same token, the diffusers may be readily unscrewed by hand from their saddles in the field and replaced with a new one or another one of different size.

When mounting the diffusers in the field, either initially or after a tank has been drained, the saddles can be easily cleaned, by hosing and/or wiping the upstanding boss part, to prepare the same for mounting of the diffuser assembly. There are no recesses to be wiped out.

Either in the field, or when shipped to the field, the pipe with mounted saddles can be provided with predetermined fluid flow control means including complete shut-off. The latter is provided by a solid or imperforate disk held in position by a follower which may even be a pipe plug. Where controlled fluid flow is desired, a perforated disk having a predetermined orifice size can be installed and held in place by an air deflector, as illustrated and described. In the field, the orifice size can be changed, if desired, by replacement with another orificed disk having a different orifice of predetermined size. It will be noted that the O-ring seal under the disk prevents gas leakage between the interface of the saddle and pipe so that the saddle mounting on the pipe is not relied upon to provide the seal. In operation of a grid, typical pressure drop at normal operating flows across the system is 9–10 inches water column. This would be split equally between the loss across the orifice and the loss across the diffuser plate. Of course, varying airflow rates would cause the losses to rise and fall accordingly.

As mentioned hereinabove, in the event of liquid backflow through the diffuser elements, the same drains from the plenum through the passages in the air deflector and the pipe hole, into the interior of pipe. This backflow liquid collects in the pipe grid and may be removed in any suitable manner, such as by blow-off assemblies (not shown) arranged at diagonally opposite corners of each grid.

It will be understood that any suitable diffuser element which will produce bubbles may be employed in the practice of the present invention, although preferably it should produce fine bubbles.

While the embodiment illustrated and described is apparatus for diffusing air through sewage, it is to be understood that any fluid may be diffused or discharged such as another gas besides air or even a liquid, and that any body of liquid may be treated besides sewage such as wastewater or liquor of any composition which will benefit from a submerged treatment with a fluid. The invention is to be measured by the scope of the appended claims interpreted in the light of the foregoing disclosure.

What is claimed is:

1. In apparatus for the submerged introduction of a fluid into a body of liquid, the combination comprising:

a length of fluid supply pipe having uniformly spaced diffuser location holes arranged in a line along its length;

one-piece saddle means secured to the exterior of said pipe over each of said holes, including a protruding boss part having an end surface, external screw threads on its side, and a central portion extending from said end surface toward said pipe opposite the corresponding one of said holes and having a through opening leading from said end surface and communicating with said one of said holes in said pipe, said opening being larger than said one of said holes; and fluid flow control means arranged in said opening for controlling the flow of fluid through said one of said holes, including zero flow if desired;

said saddle means being adapted to support a diffuser assembly having internal threads screwed onto said external threads.

2. The combination according to claim 1 wherein said saddle means further includes at the base of said external threads a shoulder against which said diffuser assembly can be bottomed when tightened down.

3. The combination according to claim 2 wherein said shoulder carries seal means engageable by said diffuser assembly when tightened down to prevent fluid leakage along the threaded connection.

4. The combination according to claim 2 wherein the diffuser assembly is selected from a group of such assemblies severally having a similar construction but a different effective effluent area and interchangeable one with another in being mountable on said saddle means, any one of said group when bottomed on said shoulder presenting its effluent area at the same spacing from said shoulder.

5. In apparatus for the submerged introduction of a fluid into a body of liquid, the combination comprising;

a length of fluid supply pipe having uniformly spaced diffuser location holes arranged in a line along its length;

saddle means secured to said pipe at each of said holes, including a protruding boss part having an end surface, external screw threads on its side, and a through opening leading from said end surface and communicating with the corresponding one of said holes; and fluid flow control means arranged in said opening for controlling the flow of fluid through said one of said holes, including zero flow if desired, said flow control means including a member arranged in said opening, an annular seal arranged in said opening between said member and said pipe and surrounding said one of said holes, and a follower pressing said member against said seal, thereby to prevent fluid leakage between said seal and pipe.;

said saddle means being adapted to support a diffuser assembly having internal threads screwed onto said external threads.

6. The combination according to claim 5 wherein said member includes an orifice communicating with said one of the pipe holes, and said follower is mounted in said opening and has a threaded connection to said saddle means to permit being tightened down against said member, said follower having a passage establishing communication between said orifice and said end surface of said protruding boss part.

7. The combination according to claim 6 wherein said follower extends outwardly of said end surface to provide an exposed outer part, and said passage includes a main portion intercepted by a cross portion leading to the exterior of said exposed outer part.

8. The combination according to claim 7 wherein said exposed outer part of said follower includes a flange extending outwardly above the outer ends of said cross portion of said passage for deflecting laterally fluid discharged from said passage.

9. The combination according to claim 7 wherein said end surface is dished and said exposed outer part of said follower extends outwardly from the low region of such dished end surface.

10. In apparatus for the submerged introduction of a fluid into a body of liquid, the combination comprising:

a length of fluid supply pipe having uniformly spaced diffuser location holes arranged in a line along its length;

saddle means secured to said pipe at each of said holes, including a protruding boss part having a dished end surface, external screw threads on its side, and a through opening leading from said end surface and communicating with the corresponding one of said holes in said pipe; and fluid flow control means arranged in said opening for controlling the flow of fluid through said one of said holes, including zero flow if desired;

said saddle means being adapted to support a diffuser assembly having internal threads screwed onto said external threads, said diffuser assembly comprising a porous diffuser element and a holder for said diffuser element including a lower mounting part, an upper diffuser element support part and an upwardly and outwardly extending intermediate part connecting said lower and upper parts, the upper surface of said intermediate part of said holder being substantially coterminous with said end surface jointly therewith to provide a basin below said diffuser element.

11. The combination according to claim 1 wherein said diffuser assembly comprises a porous diffuser element having an upper effluent surface and a lower influent surface, and a holder for said diffuser element including a lower mounting part, an upper diffuser element support part and an upwardly and outwardly extending intermediate part connecting said lower and upper parts, said lower part having internal screw threads screwable onto said external screw threads on said boss part, and means holding the marginal part of said diffuser element in sealed support on said upper part.

12. The combination according to claim 11 wherein said holding means includes a snap-on collar.

13. The combination according to claim 12 wherein said snap-on collar includes hooks which engage a corner on said holder having a sharp edge of less than a 90° included angle between the meeting surfaces which form it.

* * * * *